US008443531B2

(12) United States Patent
Lapauw et al.

(10) Patent No.: US 8,443,531 B2
(45) Date of Patent: May 21, 2013

(54) DEVICE FOR FEEDING, IRONING, FOLDING AND STACKING OF LINEN

(75) Inventors: Dominique Lapauw, Heule (BE); Yves Lapauw, Heule (BE)

(73) Assignee: Lapauw International NV (BE)

( * ) Notice: Subject to any disclaimer, the term of this patent is extended or adjusted under 35 U.S.C. 154(b) by 231 days.

(21) Appl. No.: 12/934,698

(22) PCT Filed: Mar. 30, 2009

(86) PCT No.: PCT/IB2009/005116

§ 371 (c)(1),
(2), (4) Date: Dec. 3, 2010

(87) PCT Pub. No.: WO2009/118643

PCT Pub. Date: Oct. 1, 2009

(65) Prior Publication Data

US 2011/0126435 A1 Jun. 2, 2011

(30) Foreign Application Priority Data

Mar. 28, 2008 (BE) ..... 2008/0193

(51) Int. Cl.
*D06F 67/04* (2006.01)
*D06F 61/00* (2006.01)
*B31F 1/00* (2006.01)

(52) U.S. Cl.
USPC ..... 38/44; 38/143; 493/418; 493/444; 493/25

(58) Field of Classification Search
USPC ..... 38/143, 14, 2, 7, 44, 56, 144; 493/23, 493/416, 418, 425, 405, 444
See application file for complete search history.

(56) References Cited

U.S. PATENT DOCUMENTS 2,000,063 A * 5/1935 Couch ..... 493/19
2,177,262 A * 10/1939 Neckel ..... 493/15
2,214,857 A * 9/1940 Johnson ..... 493/444
3,703,280 A * 11/1972 Weir ..... 493/18

(Continued)

FOREIGN PATENT DOCUMENTS

EP 0404754 A 12/1990
EP 1413667 A 4/2004

(Continued)

OTHER PUBLICATIONS

International Search Report from ISA/EPO dated Sep. 4, 2009.

*Primary Examiner* — Ismael Izaguirre
(74) *Attorney, Agent, or Firm* — Symbus Law Group, LLC; Clifford D. Hyra

(57) ABSTRACT

A device for feeding, ironing, folding and stacking of linen, having a maximum depth of 2.500 mm, and when viewed in the depth direction thereof, being successively provided with a feeding unit for feeding a piece of linen to be ironed into the device, the feeding unit having detection and measuring means to measure the piece of linen, an ironing unit, having at least one ironing roll and, for each ironing roll, a heated chest for ironing the piece of linen, a folding unit for folding the ironed piece of linen, the folding unit being provided with a longitudinal folding portion located after the ironing mangle for longitudinally folding the ironed piece of linen, and a cross folding portion located below the ironing mangle for cross folding the ironed piece of linen, and a stacking unit located to the right or left of the device for stacking the folded linen.

14 Claims, 7 Drawing Sheets

U.S. PATENT DOCUMENTS

| | | | | |
|---|---|---|---|---|
| 3,795,995 | A | 3/1974 | Johnson | |
| 4,327,510 | A * | 5/1982 | Grantham | 38/8 |
| 5,079,867 | A * | 1/1992 | Kober et al. | 38/2 |
| 6,993,863 | B2 * | 2/2006 | Baboz | 38/143 |

FOREIGN PATENT DOCUMENTS

| | | | |
|---|---|---|---|
| JP | 07194900 | A | 8/1995 |
| WO | 03/104542 | A | 12/2003 |
| WO | 20071134601 | A | 11/2007 |

* cited by examiner

DEVICE FOR FEEDING, IRONING, FOLDING AND STACKING OF LINEN

This application claims the benefit of Belgian patent application No. 2008/0193, filed Mar. 28, 2008, which is hereby incorporated by reference in its entirety.

BACKGROUND

The term "linen" includes bed linen such as inter alia sheets, fitted sheets, draw sheets, bedspreads, duvet sheets, pillow cases, etc. and also table linen such as inter alia tablecloths and napkins, etc. having a minimum width of 1 m and a maximum width of 3.3 m. Flat products made of terry toweling are not included here.

Various devices which are provided for feeding, ironing and folding of linen are already commercially available. Thus, for example, apparatuses are known from the companies Electrolux, Chicago Dryer, Primus, etc. which utilize a heated roll for ironing the linen introduced into the feeding unit. However, the disadvantage of such apparatuses is that these are large apparatuses having a depth of more than 3.00 m, as a result of such apparatuses take up a lot of space in a building and are in addition difficult to transport, because they cannot be placed on a standard lorry having a width of 2.35-2.40 m.

The Comfort apparatus from the company Laco Machinery is a more compact apparatus for feeding, ironing and folding of linen. This apparatus also utilizes a heated chest for ironing the linen introduced into the feeding unit. However, this apparatus has the disadvantage that the capacity is very limited; that is to say, merely 100 sheets can be ironed and folded up per hour by one operator.

SUMMARY

The invention relates to a device for feeding, ironing, folding and stacking of linen, the device having a maximum depth of 2.500 mm, and the device, when viewed in the depth direction thereof, being successively provided with

- a feeding unit for feeding a piece of linen to be ironed into the device;
- an ironing unit, comprising at least one ironing roll and, for each ironing roll, a heated chest for ironing the piece of linen introduced into the feeding unit; the feeding unit being provided with detection and measuring means to measure the length and the width of the piece of linen before said piece of linen enters the ironing unit;
- a folding unit for folding the ironed piece of linen, the folding unit being provided with
  - a longitudinal folding portion which is located, viewed in the depth direction of the device, after the ironing mangle and which is provided for longitudinally folding the ironed piece of linen;
  - a cross folding portion which is located, viewed in the depth direction of the device, below the ironing mangle and which is provided for cross folding the ironed piece of linen;

and is provided with a stacking unit which is located, when viewed in the depth direction of the device, to the right or left of the device, and which is provided for stacking the folded linen.

The object of the invention is accordingly to provide a device for feeding, ironing, folding and stacking of linen, wherein this apparatus takes up as little space as possible and can be transported in its entirety, subject if necessary to the removal of a minimal number of components from the device, on a standard lorry, and has a capacity which is as large as the capacity of the larger ironing devices, that is to say, to iron up to about 450 pieces of linen per hour per operator, or from about 700-850 sheets per hour with 2 operators.

This object is achieved by providing a device for feeding, ironing, folding and stacking of linen, the device having a maximum depth of 2.500 mm, and the device, when viewed in the depth direction thereof, being successively provided with

- a feeding unit for feeding a piece of linen to be ironed into the device;
- an ironing unit, comprising an ironing mangle which consists of at least one ironing roll and, for each ironing roll, a heated chest for ironing the piece of linen introduced into the feeding unit;
- the feeding unit being provided with detection and measuring means to measure the length and the width of the piece of linen before said piece of linen enters the ironing unit;
- a folding unit for folding the ironed piece of linen, the folding unit being provided with
  - a longitudinal folding portion which is located, viewed in the depth direction of the device, after the ironing mangle and which is provided for longitudinally folding the ironed piece of linen;
  - a cross folding portion which is located, viewed in the depth direction of the device, below the ironing mangle and which is provided for cross folding the ironed piece of linen;

and is provided with a stacking unit which is located, viewed in the depth direction of the device, to the right or left of the device;

wherein

- the feeding unit is provided either with one feeding station which is located, viewed in the depth direction of the device, to the left or right of the device, or with two feeding stations which are located, viewed in the depth direction of the device, to the left and right of the device, and which are provided to introduce a piece of linen to be ironed into the feeding unit by feeding one corner or an edge of the piece of linen to be ironed into the said feeding station; and
- the feeding unit comprises a correction roll which is provided for spreading thereon the piece of linen fed into the feeding unit;
- the feeding unit is provided with a suction system for transferring the piece of linen from the correction roll to the ironing unit by means of suction;
- the ironing path is between 1.500 and 3.020 mm.

The term "the depth direction of the device" refers to the direction from the feeding unit toward the folding unit. The "ironing path" is the contact distance between the chest and the ironing roll.

As a result of the provision of such a device, it is possible, on a very limited surface area, having a maximum depth of 2.500 mm, for 1 operator to introduce up to 450 pieces of linen to be ironed per hour, or from 700-850 sheets with 2 operators per hour. Furthermore, it is the case that 1 of the persons operating the apparatus can remove the folded pieces of linen from the stacking unit. In addition, the device can be transported in one go, subject to the removal of the burner if the device runs on gas, on a standard lorry. All of this is impossible with the known devices.

Such an ironing path can be obtained by providing one ironing roll having a diameter of more than 1.000 mm, and the surface of the ironing roll covers at least 170° of the surface of the chest (=contact angle). However, this ironing path can also be obtained by providing two or more ironing rolls with a diameter, the sum of which is at least 1.000 mm. The contact angle can thus in each case be at least 170°, but the various ironing rolls can also have a different contact angle, typically between 170° and 290°. The condition is that the total ironing path be at least 1.500 mm.

The ironing path is preferably substantially 3.000 mm. If one ironing roll is used, the ironing roll has in this case a diameter of substantially 1.200 mm, and the surface of the ironing roll covers substantially 286° of the surface of the chest. If a plurality of ironing rolls is used, these ironing rolls have in total a diameter of substantially 1.200 mm, and preferably a contact distance between the chest and the ironing roll of 170° for each ironing roll. However, as specified hereinbefore, the various ironing rolls can also have a different contact angle, typically between 170° and 290°; provided that a total ironing path of substantially 3.000 mm is obtained.

In a preferred embodiment of a device according to the invention, each of the said feeding stations is provided with a supply belt which is provided to suck by means of a vacuum system the said edge or corner of the piece of linen against the respective supply belt. This can be any edge or any corner of the piece of linen.

This supply belt can therewith be arranged both statically and rotatably with respect to the device.

In a more preferred embodiment of a device according to the invention, the supply belt is arranged obliquely with respect to a vertical plane. As a result of the oblique arranging of the supply belts, the person operating the device can put on the piece of linen to the supply belt irrespective of his size. In addition, as a result of the fact that the supply belts are arranged obliquely, the piece of linen to be ironed can, at least in part, hang vertically before it is moved further into the feeding unit.

Each of the said feeding stations is preferably provided with one or more movably arranged clamps which are provided for taking over the piece of linen which is to be ironed and is located on the respective supply belt, and spreading the piece of linen which is to be ironed and is taken over by the said clamps before the piece of linen is introduced into the ironing unit. In this way, the piece of linen which is introduced by means of one edge or corner is spread without tension before the piece of linen is introduced into the ironing unit.

More preferably, the feeding unit comprises a guide module which is provided for guiding the said movably arranged clamps during the spreading of the said piece of linen to be ironed.

In an advantageous embodiment of a device according to the invention, the feeding unit comprises one or more detection photocells in order to position the edge which is located, viewed in the depth direction of the device, at the bottom of the piece of linen to be ironed substantially parallel to the longitudinal axis of the correction roll.

In a particular embodiment of a device according to the invention, the said detection and measuring means, which are provided to measure the length and the width of the piece of linen before said piece of linen enters the ironing unit, consist of one or more photocells and one or more pulse counters.

In an advantageous preferred embodiment of a device according to the invention, the said suction system is provided with

- a suction shaft into which the piece of linen can be sucked;
- a top suction portion which is provided for sucking the piece of linen into the suction shaft;
- a blocking clamp which is provided to clamp the piece of linen in a clamping position, this blocking clamp being arranged in such a way that there is located after the clamping of the piece of linen a portion of this piece of linen above this blocking clamp that can be sucked by the top suction portion into the suction shaft; and
- a bottom suction portion which is provided for further taking along the piece of linen, which is partly sucked up by the top suction portion into the suction shaft, in the direction of the ironing unit once the blocking clamp has released the piece of linen and once the top suction portion is set to non-active.

Preferably, the bottom suction portion consists of one or more perforated conveyor belts, wherein the piece of linen to be taking along is sucked toward the perforated conveyor belts as a result of suction through the perforations.

More preferably, the bottom and top suction portions herewith suck in the piece of linen.

In one particular device according to the invention, the feeding unit is provided with rotatably arranged brushes which are provided for brushing off the side edges of the piece of linen during the introduction thereof into the ironing mangle of the ironing unit.

An advantageous embodiment of the device according to the invention is provided, both to the left and to the right, viewed in the depth direction of the device, with a feeding station. In this way, two persons can operate the device at the same time and the capacity becomes even greater.

This invention will now be commented on in greater detail based on the subsequent detailed description of a preferred device for feeding, ironing and folding of linen according to the invention. The purpose of this description is exclusively to provide a clarificatory example and to indicate further advantages and special features of this invention, and may thus in no way be interpreted as a limitation of the scope of application of the invention or of the patent rights sought in the claims.

BRIEF DESCRIPTION OF THE DRAWINGS

In this detailed description, reference numerals are used to refer to the appended drawings, in which.

DETAILED DESCRIPTION

Figure 1:
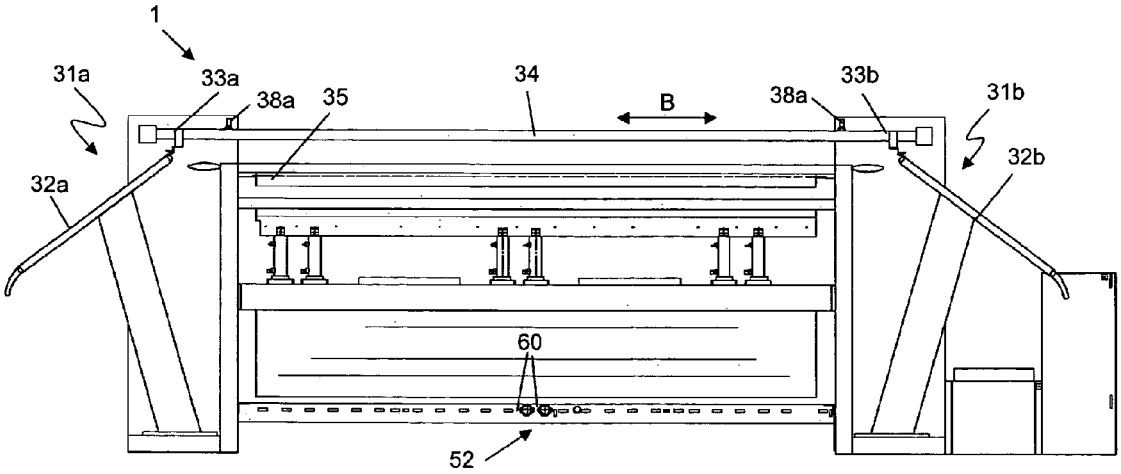
FIG. 1 is a front view of a device for feeding, ironing and folding of linen according to the invention.
Figure 2:
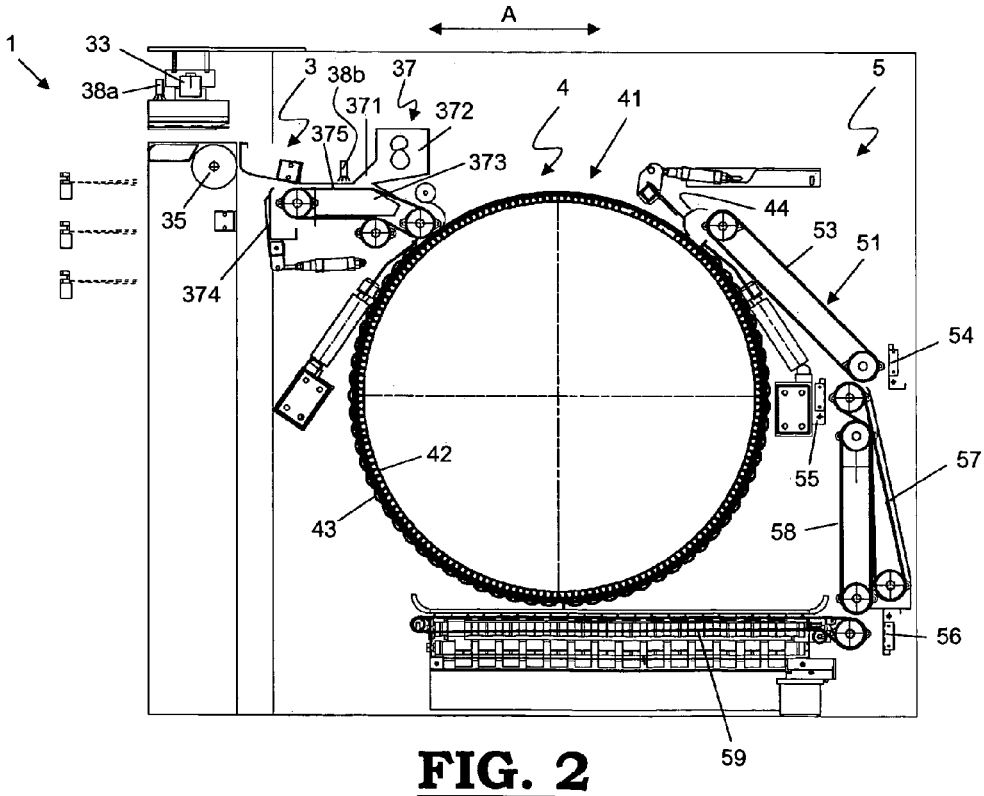
FIG. 2 is a cross section of a device as illustrated in FIG. 1.
Figure 12:
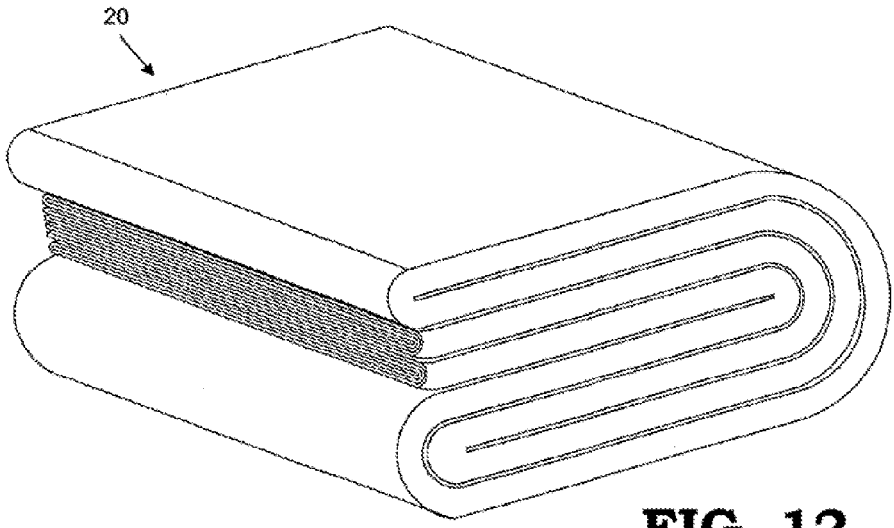
FIG. 12 is a perspective view of an example of a piece of linen which is ironed and folded by means of a device according to the invention.

A device (1) for feeding, ironing, folding and stacking of linen (2*a*, 2*b*) according to the invention, as is illustrated in FIGS. 1 and 2, has a maximum depth of 2.500 mm. The device (1) comprises, viewed successively in the depth direction (A) of the device (1), a feeding unit (3) for feeding a piece of linen (2*a*, 2*b*) to be ironed into the device (1), an ironing unit (4) for ironing the piece of linen (2*a*, 2*b*) introduced into the device (1), a folding unit (5) for folding the ironed piece of linen (2*a*, 2*b*) in such a way that a folded piece of linen (20) is obtained (an example of which is illustrated in FIG. 12).

As may be seen in FIGS. 2, 6, 8, 9 and 10, the ironing unit (4) is provided with an ironing mangle (41) which consists of an ironing roll (42) and, for each ironing roll (42), a heated chest (43) for ironing the piece of linen (2*a*, 2*b*) introduced into the feeding unit (3). The contact distance between the chest (43) and the ironing roll (42), also referred to as the ironing path, is in this case between 1.500 and 3.020 mm [=the latter value corresponding to substantially the entire diameter of the ironing roll (42)]. The chest (43) is heated by means of thermal oil or steam. The thermal oil is heated up in the device (1) itself by means of a heat source which can be selected from steam, electricity, gas or light fuel oil. The chest (43) is provided to be pressed hydraulically against the ironing roll (42). The ironing roll (42) is provided with springs and a felt of 4,000 g/m$^2$, which is constantly under vacuum by means of the strong roll suction.

The ironing unit (4) is further provided with one or more scrapers (44) for scraping off the ironed piece of linen (2*a*, 2*b*) from the ironing roll (42). The said scrapers are herewith arranged obliquely above the ironing mangle (41).

Figure 3:
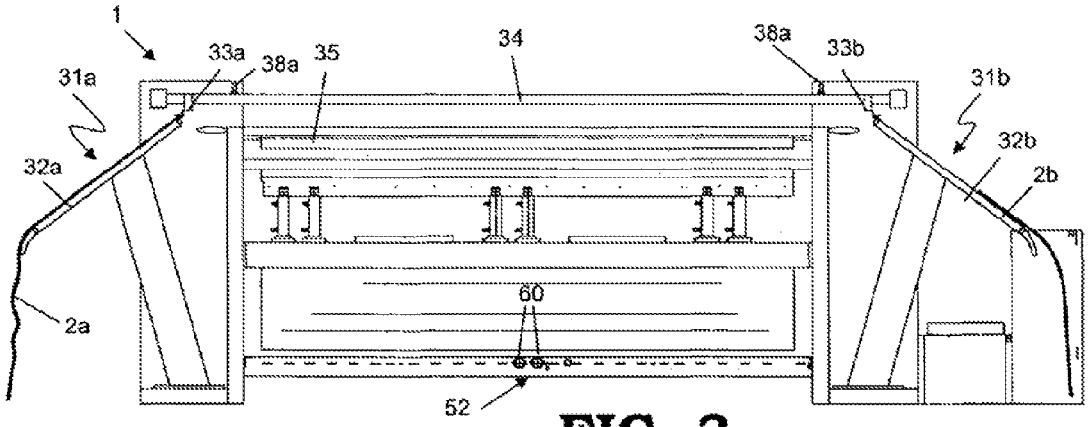
FIG. 3 is a front view of the device as illustrated in FIG. 1, a piece of linen being provided on each supply belt.

As may be seen in FIGS. 1, 3 up to 5 and including 7 and 11, the feeding unit (4) is provided with 2 feeding stations (31*a*, 31*b*) which are located, viewed in the depth direction (A) of the device (1), to the left and right of the device (1). It is however also possible to provide just one, such a feeding station (31*a* or 31*b*) which is placed to the left or right of the device (1). Each feeding station (31*a*, 31*b*) is provided for feeding a piece of linen (2*a*, 2*b*) into the feeding unit (3) by feeding one corner or an edge of the piece of linen (2*a*, 2*b*) into the said feeding station (31*a*, 31*b*). For supplying the piece of linen (2*a*, 2*b*) into the feeding unit (3), each feeding station (31*a*, 31*b*) is provided with a supply belt (32*a*, 32*b*) which is provided in order to suck by means of a vacuum system (not illustrated in the figures) the said edge or corner of the piece of linen (2*a*, 2*b*) to be ironed against the supply belt (32*a*, 32*b*). The supply belt(s) (32*a*, 32*b*) is (are) in this case arranged obliquely with respect to a vertical plane (as may be seen in FIGS. 1, 3-5, 7 and 11). This supply belt/these supply belts (32*a*, 32*b*) can in this case both be arranged statically and be arranged so as to be rotatable with respect to the device (1).

Furthermore, each of the said feeding stations (31*a*, 31*b*) is provided with a movably arranged clamp (33, 33*a*, 33*b*) which are provided for taking over the piece of linen (2*a*, 2*b*) which is to be ironed and is located on the respective supply belt (32*a*, 32*b*) by preferably claming this piece of linen (2*a*, 2*b*) to be ironed, and spreading the clamped piece of linen (2*a*, 2*b*) to be ironed before the piece of linen (2*a*, 2*b*) is introduced into the ironing unit (4). The said clamps (33, 33*a*, 33*b*) are preferably opened pneumatically and closed by cylinders. It should be noted that more than one movably arranged clamp (33, 33*a*, 33*b*) can also be provided for each feeding station (31*a*, 31*b*).

A guide module (34) is provided for guiding the movement of the said movably arranged clamps (33, 33*a*, 33*b*) during the spreading of the said piece of linen (2*a*, 2*b*). This guide module (34) comprises two carriages (not illustrated in the figures) to which one clamp (33) is attached for each carriage. The movement of these carriages is driven by means of frequency-controlled AC motors.

The feeding unit (3) further comprises a (cylindrical) correction roll (35) on which the centering of the said piece of linen (2*a*, 2*b*) is carried out by means of the said movably arranged clamps (33). The movably arranged clamps (33, 33*a*, 33*b*) pull in this case the piece of linen (2*a*, 2*b*) to be ironed over the correction roll (35) in the longitudinal direction (B) thereof. The centering allows in this case all of the linen (2*a*, 2*b*) to be ironed.

Furthermore, the correction roll (35) is also provided for correcting the position of the bottom edge (12) of the piece of linen (2*a*) put on the correction roll (35), viewed in the depth direction (A) of the invention, with respect to the longitudinal axis of the correction roll (35), in interaction with one or more detection photocells (36).

The said correction roll (35) is therewith preferably exerted as a twist tube, each end of this twist tube (35) being driven by means of a servomotor (not illustrated in the figures) as a result of which twist tube (35) is twisted. The twist tube (35) can for example consist of a helically wound wire which is covered with a supple material. This allows the twist tube (35) to be rotated about its geometric axis in the right or left direction, depending on the direction of rotation of the servomotors.

Figure 5:
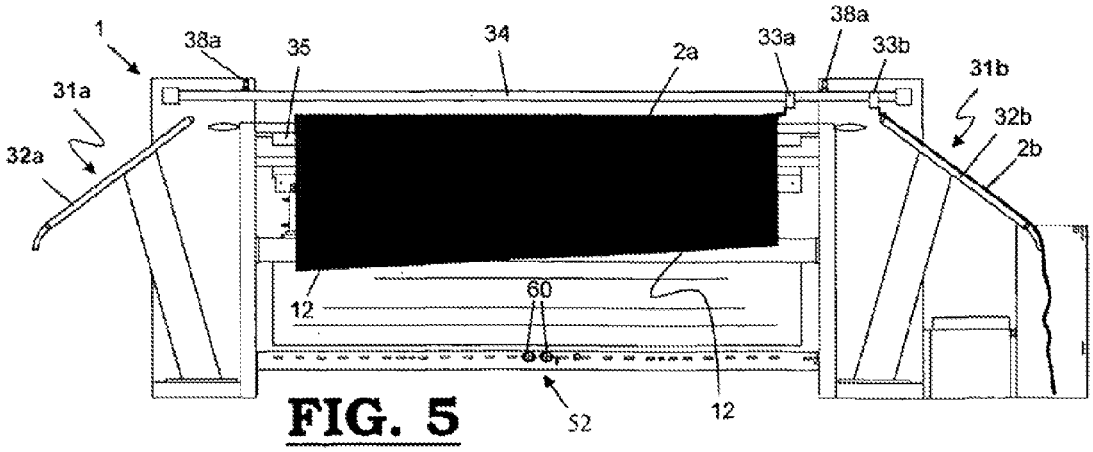
FIG. 5 is a front view of a device as illustrated in FIG. 1, one piece of linen being centered on the correction roll.
Figure 7:
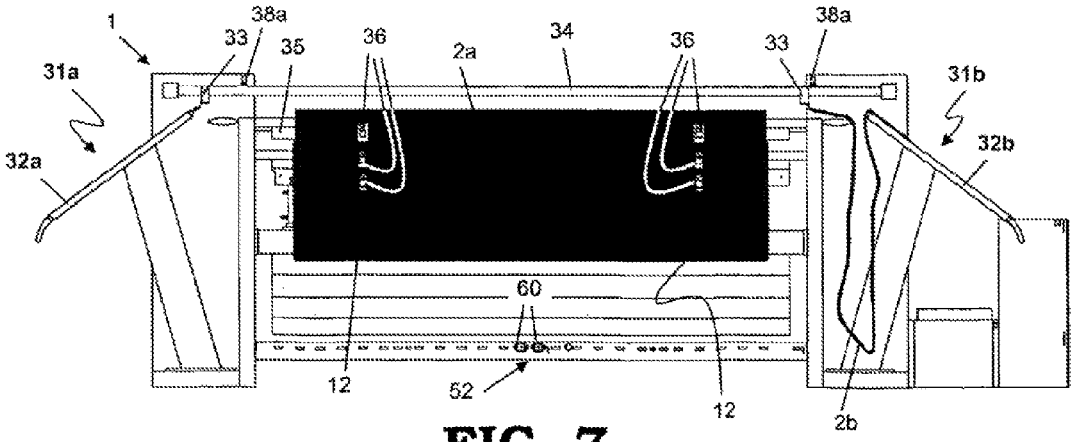
FIG. 7 is a front view of FIG. 6, showing that the second piece of linen is ready to be brought to the correction roll.

As is illustrated in FIG. 5, the bottom edge (12) of the piece of linen (2*a*) put on the correction roll (35) is located, viewed in the depth direction (A) of the invention, usually first obliquely with respect to the longitudinal axis of the correction roll (35). After correction of the position of the said edge, this edge is located substantially parallel to the longitudinal axis of the correction roll (35), as is illustrated in FIG. 7.

As may be seen in FIGS. 2, 6, 8, 9 and 10, the feeding unit (3) is provided with a suction system (37) for introducing the piece of linen (2*a*, 2*b*), which is to be ironed and is introduced into the feeding unit (3), into the ironing unit (4) by means of suction, thus allowing the piece of linen (2*a*, 2*b*) to be ironed to be introduced into the ironing unit (4) without clamps. The suction unit (37) comprises in this case

- a suction shaft (371) into which the piece of linen (2*a*, 2*b*) can be sucked;
- a top suction portion (372) which is provided for sucking the piece of linen (2*a*, 2*b*) into the suction shaft (371);
- a blocking clamp (374) which is provided to clamp the piece of linen (2*a*, 2*b*) in a clamping position, and which is arranged in such a way that there is located after the clamping of the piece of linen (2*a*, 2*b*) a portion of this piece of linen (2*a*, 2*b*) above this blocking clamp (374) that can be sucked by the top suction portion (372) into the suction shaft (371);
- a bottom suction portion (373) which is provided for further taking the piece of linen (2*a*, 2*b*), which is partly sucked up by the top suction portion (372) into the suction shaft (371), along in the direction of the ironing unit (4) once the blocking clamp (374) has released the piece of linen (2*a*, 2*b*) and once the top suction portion (372) is set to non-active.

The blocking clamp (374) is therewith controlled hydraulically or pneumatically. The blocking clamp (374) can however also be controlled in a different manner. The top and bottom suction portions (372, 373) preferably therewith suck the piece of linen (2*a*, 2*b*) in.

Furthermore, the feeding unit (3) is provided with detection and measuring means to measure the length and the width of the piece of linen (2*a*, 2*b*) before said piece of linen enters the ironing unit (4). These detection and measuring means consist therewith preferably of one or more photocells (38*a*, 38*b*) and one or more pulse counters (not illustrated in the figures). The width of the linen (2*a*, 2*b*) is therewith measured by one or more photocells (38*a*) (see FIGS. 1 to 11) which are located at the level of the guide module (34). Therewith, one photocell (38*a*) is preferably provided for each feeding station (31*a*, 31*b*). The measuring by the pulse counter takes therewith place when the piece of linen (2*a*, 2*b*) is pulled over the correction roll (35). The measuring of the length of the piece of linen (2*a*, 2*b*) takes place by means of a photocell (38*b*) (see FIGS. 2, 6, 8, 9 and 10) which is arranged at the level of the top suction portion (372).

Finally, the feeding unit (3) is provided with rotatably arranged brushes (not illustrated in the figures) which are provided for brushing off the side edges of the piece of linen (2*a*, 2*b*) to be ironed during the introduction thereof into the ironing mangle (41).

The device (1) is finally provided with a folding unit (5) for folding the ironed piece of linen (2*a*, 2*b*).

A driven conveyor belt (53) is provided between the ironing mangle (41) and this folding unit (5) for taking along the ironed piece of linen (2*a*, 2*b*) which was scraped off from the ironing mangle (41) by means of the scrapers (44).

The said folding unit (5) is provided with

- a longitudinal folding portion (51) which is located, viewed in the depth direction (A) of the device (1), after the ironing mangle (41) and which is provided for longitudinally folding the ironed linen (2*a*, 2*b*); and
- a cross folding portion (52) which is located, viewed in the depth direction (A) of the device (1), below the ironing mangle (41) and which is provided for cross folding the ironed piece of linen (2*a*, 2*b*).

The longitudinal folding portion (51) is therewith preferably provided for carrying out 1, 2 or 3 longitudinal folds. In the device (1) as illustrated in FIGS. 2, 6, 8, 9 and 10, three longitudinal folders (54, 55, 56) are provided for carrying out 3 longitudinal folds. The longitudinal folding is therewith preferably carried out by means of an air jet which is activated at a calculated moment, which is calculated by a photocell, and the associated electronic controller, for example a PLC controller. The longitudinal folding portion (51) is therewith provided with conveyor belts (57, 58) for taking along the ironed piece of linen (2*a*, 2*b*), which is to be folded longitudinally, through the longitudinal folding portion (51).

One or more conveyor belts (59) are provided between the longitudinal folding portion (51) and the cross folding portion (52) for displacing the longitudinally folded piece of linen (2*a*, 2*b*) to the cross folding portion (52).

Figure 11:
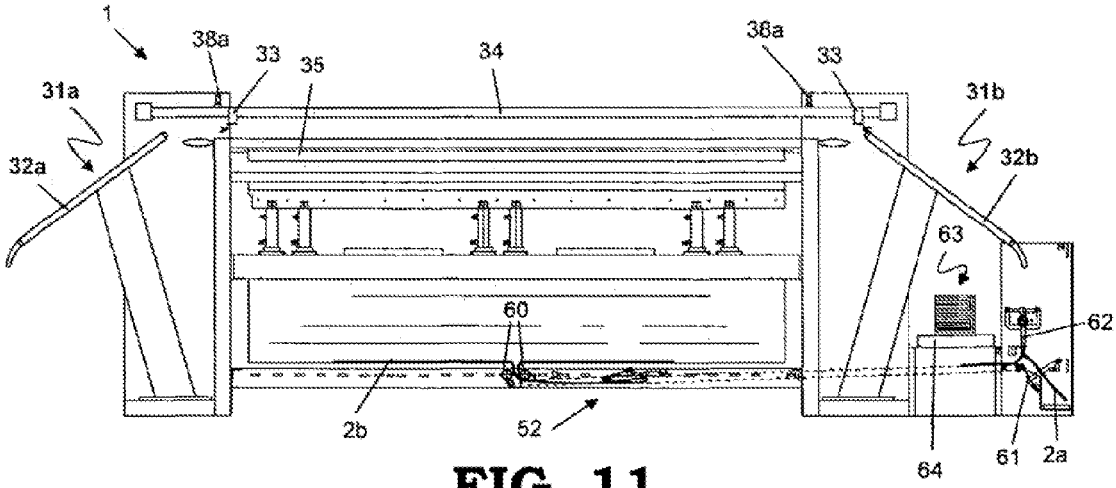
FIG. 11 is a front view of a device as illustrated in FIG. 1, the two pieces of ironed linen being cross folded and stacked.

The cross folding portion (52) is preferably also provided for carrying out 1, 2 or 3 cross folds. As is illustrated in FIG. 11, the cross folding portion (52) is in this case provided with

- a blowpipe or a knife (not illustrated in the figures), and one or more conveyor webs (60)/rolls for carrying out a first cross fold;
- a blowpipe or a knife (not illustrated in the figures), and one or more reversible conveyor belts (not illustrated in the figures) for carrying out a second cross fold; and
- a knife (61) and a clamp (62) for carrying out a third cross fold.

Finally, the device (1) is preferably provided with a stacking unit (63) which is located, viewed in the depth direction (A) of the device (1), to the right or left of the device (1). The clamp (62) mentioned hereinbefore is therewith also provided to stack the longitudinally and cross folded piece of linen (20) on a delivery belt (64) of the stacking unit (63). When 5 pieces of folded-up linen (20) are stacked on one another, said pieces of linen can automatically be discharged. Since this stacking unit (63) is located, viewed in the depth direction (A) of the device (1), to the left or right of the device (1), one of the 2 operators can unstack the folded items of linen (20). This thus takes place usually in packs of 5 pieces of folded-up linen (20).

All components of the device (1) are in this case controlled by one and the same motor.

The manner in which this exemplary embodiment of the device according to the invention functions, as is shown in FIG. 3 up to and including 11, is as follows:

FIG. 3: An edge or a corner of the piece of linen (2*a*, 2*b*) to be ironed is placed on each supply belt (32*a*, 32*b*) of the feeding stations (31*a*, 31*b*), and is adhered to the supply belt (32) by means of vacuum. On the left-hand feeding stations (31*a*), the supply belt (32) feeds the edge or the corner of the piece of linen (1) to be ironed up to the respective clamp (33*a*) so that said clamp closes and the edge is trapped in this clamp (33*a*). While the left-hand feeding station (31*a*) fixes the piece of linen (2*a*) in the said clamp (33), a second piece of linen (2*b*) can on the right-hand feeding station (31*b*) be laid ready in a waiting position (not illustrated in the figures) in order, when the first piece of linen is introduced into the ironing mangle (41), to undergo the same operation as the first piece of linen (2*a*) in the left-hand feeding station (31*a*). The supporting height of the edge of the piece of linen (2*a*, 2*b*) to be ironed is immaterial as it is arranged obliquely, in order to function ergonomically.

Figure 4:
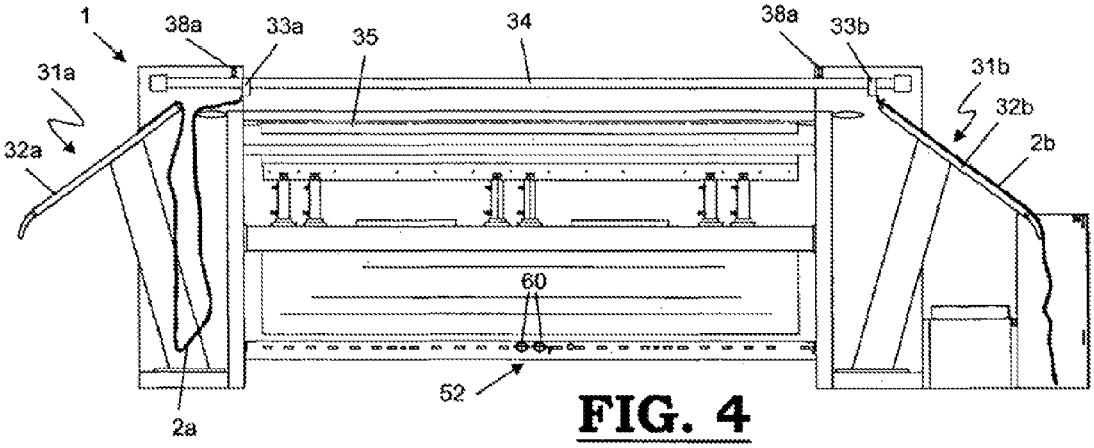
FIG. 4 is a front view of the device as illustrated in FIG. 1, one piece of linen being ready to be brought to the correction roll.

FIG. 4: The clamp (33*a*) of the left-hand feeding station (31*a*) is displaced by the guide module (34) in the direction of the right-hand feeding station (31*b*) until the complete piece of linen (2*a*, 2*b*) to be ironed is no longer located on the supply belt (32*a*).

Figure 6:
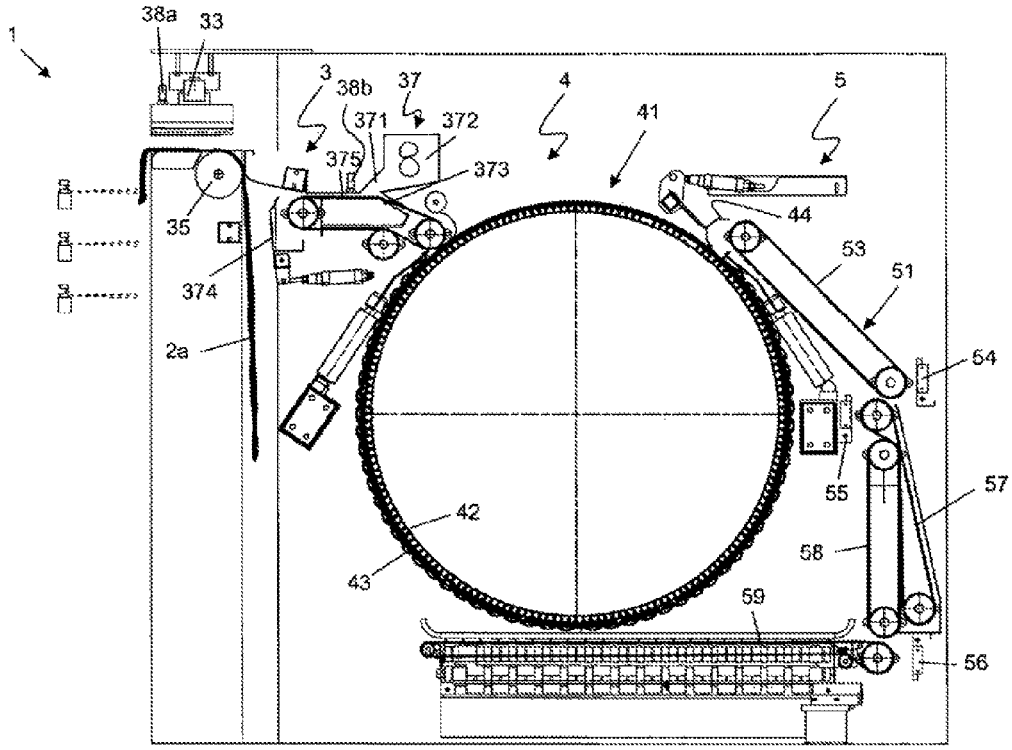
FIG. 6 is a cross section of a device as illustrated in FIG. 2, one piece of linen being corrected until the edge of the piece of linen which is located, viewed in the depth direction of the device, at the bottom is located substantially parallel to the longitudinal axis of the ironing roll.

FIGS. 5 and 6: The clamp (33*a*) takes along the piece of linen (2*a*, 2*b*) to be ironed further in the direction of the right-hand feeding station (31*b*) until the piece of linen (2*a*, 2*b*) to be ironed is centered on the correction roll (35). Afterwards, the clamp (33*a*) releases the piece of linen (2*a*, 2*b*) to be ironed, and returns to the left-hand feeding station (31*a*) via the guide module (34).

FIG. 7: When the piece of linen (2*a*) to be ironed is centered on the correction roll (35), the position of the bottom edge of the piece of linen (2*a*), which is to be ironed and is located, viewed in the depth direction of the feeding unit (3) toward the folding unit (5), before the correction roll (35), is corrected by means of 2 servomotors in combination with the detection photocells (36).

Figure 8:
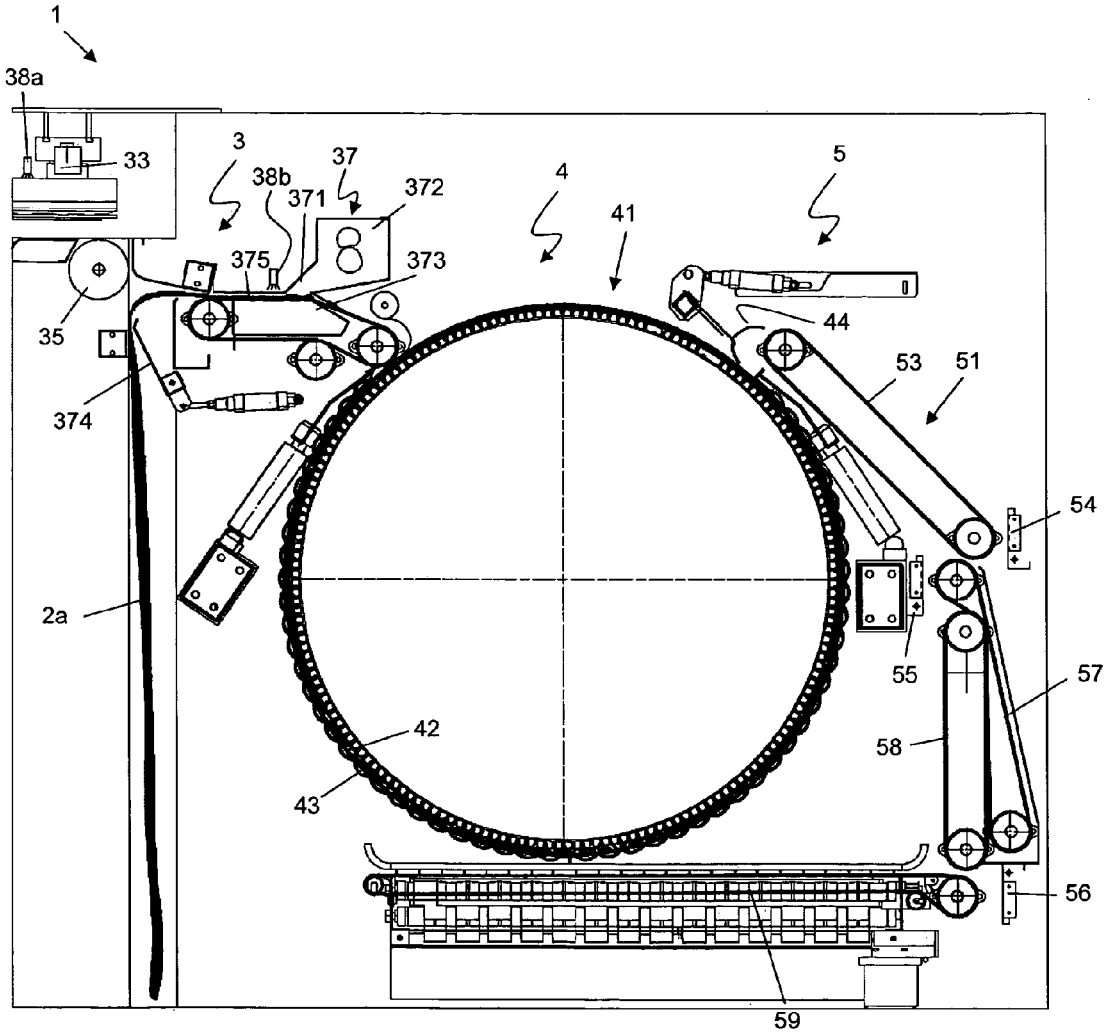
FIG. 8 is a cross section of a device as illustrated in FIG. 2, one piece of linen being brought from the feeding unit to the ironing unit by means of the suction system.

FIG. 8: Before the piece of linen (2*a*) to be ironed is fed into the ironing unit (4), said piece of linen is clamped by means of clamp (374) and the top suction portion (372) is activated so that the edge of the piece of linen (2*a*) to be ironed is located in the suction shaft (371). Once the edge of the piece of linen (2*a*) to be ironed is completely open, the top suction portion (372) is set to non-active, so that the bottom suction portion (373) is activated. While the bottom suction portion (373) is active, the piece of linen (2*a*) to be ironed is taken along under vacuum by means of the perforated conveyor belts (375), and clamp (374) is opened. Now the piece of linen (2*a*) to be ironed is displaced in the direction of the ironing mangle (41).

Figure 9:
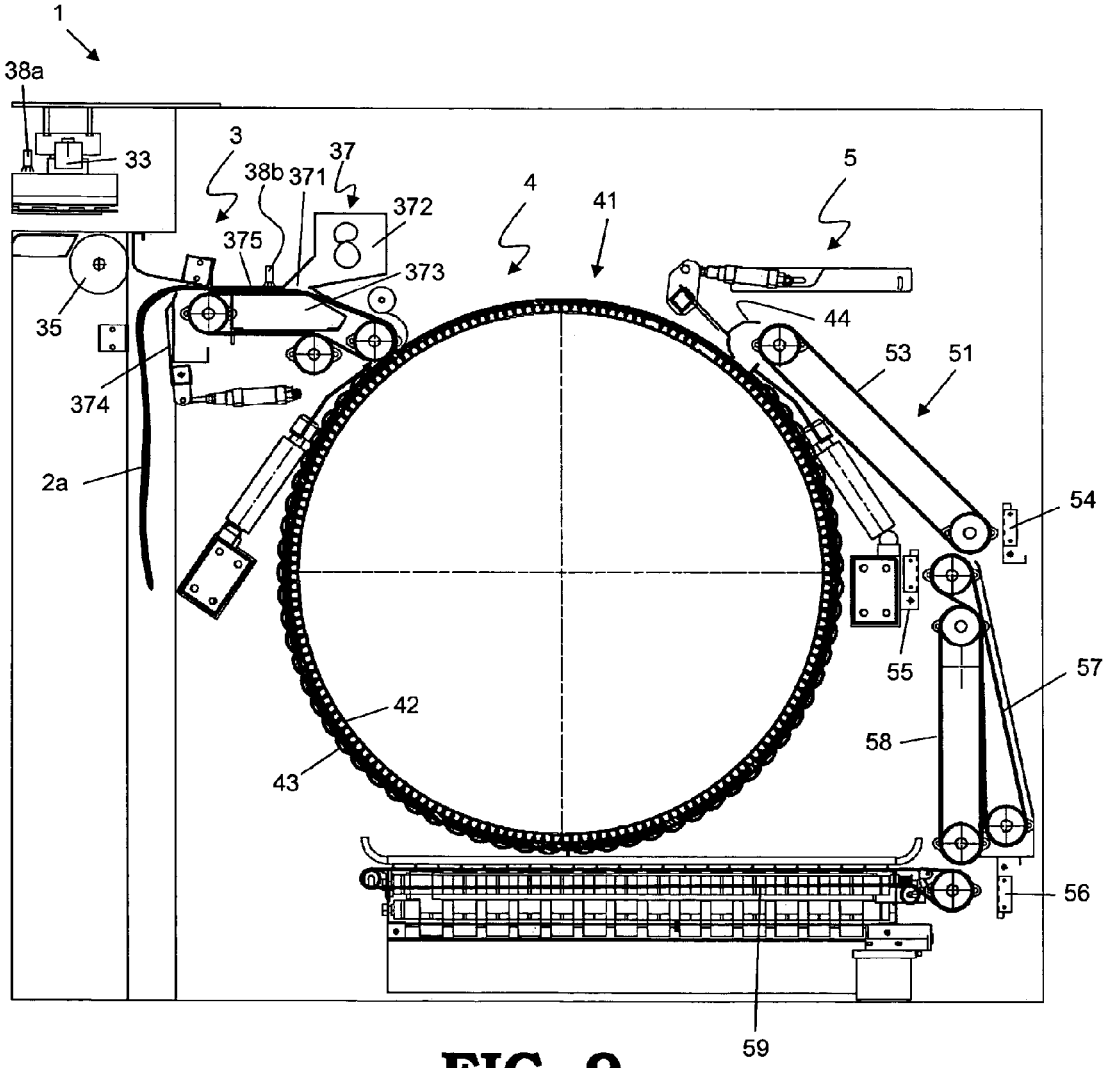
FIG. 9 is a cross section of a device as illustrated in FIG. 2, one piece of linen being ironed in the ironing mangle.

FIG. 9: The ironing bed (43) is pressed hydraulically against the ironing roll (42). While the piece of linen (2*a*) is fed into the ironing mangle (41), the side edges of the piece of linen (2*a*) to be ironed are completely brushed off by means of rotating brushes, in order to obtain an acceptable ironing quality.

Figure 10:
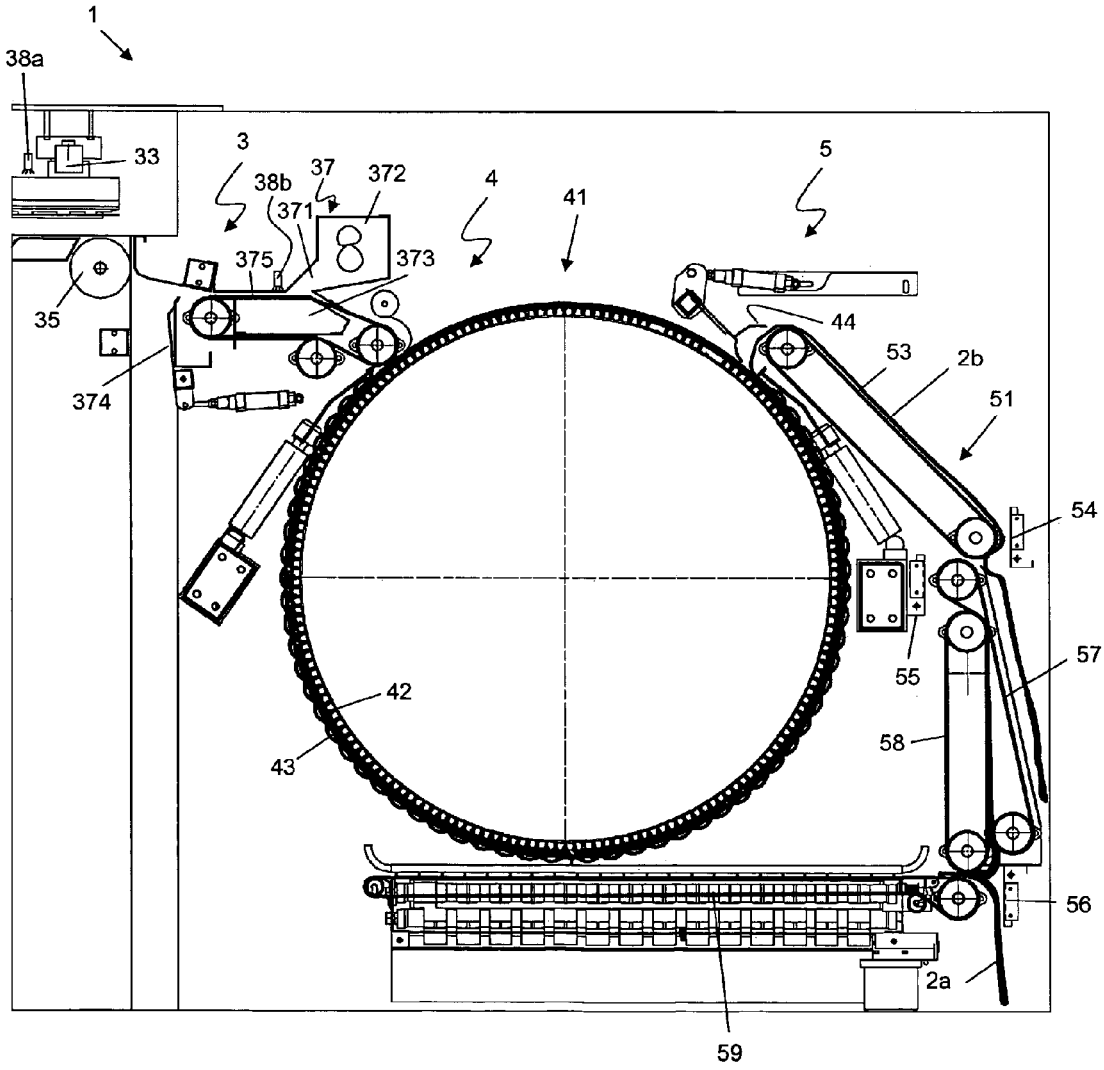
FIG. 10 is a cross section of a device as illustrated in FIG. 2, one ironed piece of linen being longitudinally folded, and the second piece of linen being scraped from the correction roll.

FIG. 10: When the piece of linen (2*a*) leaves the ironing mangle (41) on the other side, it is scraped off from the ironing roll (42) by means of the scrapers (44). Once the ironed piece of linen (2*a*) has been scraped off, it falls onto the driven conveyor belt (53) so that it is taken along to the longitudinal folding portion (51) in order to realize the 3 longitudinal folds. These longitudinal folds are carried out by the first, second and third longitudinal folders (54, 55, 56) by means of an air jet which is activated at the moment calculated by the electronic controller. In each case, when an air jet is activated, the ironed piece of linen (2*a*) to be longitudinally folded is taken of between the respective conveyor belt (57, 58) in order thus to pass to the following longitudinal folder (55, 56). Once the third longitudinal fold has been carried out, the longitudinally folded and ironed piece of linen (2*b*) is fed on the conveyor belts (59) in the direction of the cross folding portion.

FIG. 11: Once the longitudinally folded and ironed piece of linen (2*b*) has reached the correct position, the conveyor belts (57, 58) stop and the air jet is activated so that the longitudinally folded and ironed piece of linen (2*b*) is taken along between the conveyor webs (60) in order thus to carry out the first cross fold. Afterwards, the second and the third cross fold are carried out. Afterwards, the stacking clamp (62) stacks the ironed and folded-up piece of linen (20) on the delivery belt (64). Once 5 ironed and folded-up pieces of linen (20) of this type are stacked on one another, said pieces of linen are automatically delivered.

The invention claimed is:

1. A device for feeding, ironing, folding and stacking of linen, the device having a maximum depth of 2,500 mm, and the device, when viewed in the depth direction thereof, being successively provided with a feeding unit for feeding a piece of linen to be ironed into the device;

an ironing unit, comprising an ironing mangle which consists of at least one ironing roll and, for each ironing roll, a heated chest for ironing the piece of linen introduced into the feeding unit;

the feeding unit being provided with detection and measuring means to measure the length and the width of the piece of linen before said piece of linen enters the ironing unit;

a folding unit for folding the ironed piece of linen, the folding unit being provided with a longitudinal folding portion which is located, viewed in the depth direction of the device, after the ironing mangle and which is provided for longitudinally folding the ironed piece of linen;

a cross folding portion which is located, viewed in the depth direction of the device, below the ironing mangle and which is provided for cross folding the ironed piece of linen;

and is provided with a stacking unit which is located, when viewed in the depth direction of the device, to the right or left of the device, and which is provided for stacking the folded linen;

wherein;

the feeding unit is provided either with one feeding station which is located, viewed in the depth direction of the device, to the left or right of the device, or with two feed stations which are located, viewed in the depth direction of the device, to the left and right of the device and which are provided to introduce a piece of linen to be ironed into the feeding unit by feeding one corner or an edge of the piece of linen to be ironed into the said feeding station; and the feeding unit comprises a correction roll which is provided for spreading thereon the piece of linen fed into the feeding unit;

the feeding unit is provided with a suction system for transferring the piece of linen from the correction roll to the ironing unit by means of suction;

the ironing path is between 1,500 and 3,020 mm.

2. Device according to claim 1, characterized in that the ironing path is substantially 3.000 mm.

3. Device according to claim 1, characterized in that each of the said feeding stations is provided with a supply belt which is provided to suck by means of a vacuum system the said edge or corner of the piece of linen against the respective supply belt.

4. Device according to claim 3, characterized in that the supply belt is arranged obliquely with respect to a vertical plane.

5. Device according to claim 3, characterized in that each of the said feeding stations is provided with one or more movably arranged clamps which are provided for taking over the piece of linen which is to be ironed and is located on the respective supply belt, and spreading the piece of linen which is to be ironed and is taken over by the said clamps before the piece of linen is introduced into the ironing unit.

6. Device according to claim 5, characterized in that the feeding unit comprises a guide module which is provided for guiding the said movably arranged clamps during the spreading of the said piece of linen to be ironed.

7. Device according to claim 1, characterized in that the correction roll is exerted as a twist tube, each end of the twist tube being driven by means of a servomotor, such that the twist tube is twisted for correcting the position of the edge of the said piece of linen, which is located, viewed in the depth direction of the device, at the bottom of the item of linen to be ironed substantially parallel to the longitudinal axis of the correction roll.

8. Device according to claim 6, characterized in that the feeding unit comprises one or more detection photocells for detecting the edge of the said piece of linen which is spread on the correction roll and is located, viewed in the depth direction of the device from the feeding unit toward the folding unit, before the correction roll.

9. Device according to claim 1, characterized in that the said detection and measuring means, which are provided to measure the length and the width of the piece of linen before said piece of linen proceeds to the ironing unit, consist of one or more photocells and one or more pulse counters.

10. Device according to claim 1, characterized in that the said suction system is provided with a suction shaft into which the piece of linen can be sucked;

a top suction portion which is provided for sucking the piece of linen into the suction shaft;

a blocking clamp which is provided to clamp the piece of linen in a clamping position, and which is arranged in such a way that there is located after the clamping of the piece of linen a portion of this piece of linen above this blocking clamp that can be sucked by the top suction portion into the suction shaft;

a bottom suction portion which is provided for further entraining the piece of linen, which is partly sucked up by the top suction portion into the suction shaft, in the direction of the ironing unit once the blocking clamp has released the piece of linen and once the top suction portion is set to non-active.

11. Device according to claim 10, characterized in that the bottom suction portion consists of one or more perforated conveyor belts, wherein the piece of linen to be taken along is sucked against the perforated conveyor belts as a result of suction through the perforations.

12. Device according to claim 11, characterized in that the bottom and top suction portions suck in the piece of linen.

13. Device according to claim 1, characterized in that the feeding unit is provided with rotatably arranged brushes which are provided for brushing off the side edges of the piece of linen during the introduction thereof into the ironing mangle of the ironing unit.

14. Device according to claim 1, characterized in that the device is provided, both to the left and to the right, viewed in the depth direction of the device, with a feeding station.

* * * * *